US011543093B2

(12) United States Patent
Puzio et al.

(10) Patent No.: US 11,543,093 B2
(45) **Date of Patent: *Jan. 3, 2023**

(54) LIGHT APPARATUS HAVING AIR FLOW

(71) Applicant: Black & Decker Inc., New Britain, CT (US)

(72) Inventors: Daniel Puzio, Baltimore, MD (US); Daniel L. Schwarz, Timonium, MD (US); Ethan L. Helmer, Baltimore, MD (US)

(73) Assignee: Black & Decker Inc., New Britain, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/395,763

(22) Filed: Aug. 6, 2021

(65) Prior Publication Data

US 2021/0364141 A1 Nov. 25, 2021

Related U.S. Application Data

(63) Continuation of application No. 16/854,208, filed on Apr. 21, 2020, now Pat. No. 11,112,076.

(Continued)

(51) Int. Cl.

| | |
|---|---|
| ***F21S 9/02*** | (2006.01) |
| ***F21V 29/75*** | (2015.01) |
| ***F21Y 115/10*** | (2016.01) |
| ***F21V 29/83*** | (2015.01) |
| ***F21S 8/00*** | (2006.01) |

(Continued)

(52) U.S. Cl.

CPC ..... *F21S 9/02* (2013.01); *F21S 8/033* (2013.01); *F21V 5/04* (2013.01); *F21V 23/023* (2013.01); *F21V 23/0442* (2013.01); *F21V 23/06* (2013.01); *F21V 29/75* (2015.01); *F21V 29/83* (2015.01); *F21Y 2115/10* (2016.08)

(58) Field of Classification Search

CPC ..... F21L 4/00; F21V 29/83; F21V 23/0442; F21V 14/085; F21V 15/01; F21V 23/023; F21V 29/677; F21V 29/70; F21V 29/71; F21V 29/713; F21V 9/083

See application file for complete search history.

(56) References Cited

U.S. PATENT DOCUMENTS 8,371,740 B2 * 2/2013 Pestl ..... F21V 33/004 362/202
8,807,814 B1 * 8/2014 Glenn ..... F21V 21/0885 362/580

(Continued)

*Primary Examiner* — William J Carter
(74) *Attorney, Agent, or Firm* — Amir R. Rohani

(57) ABSTRACT

A lighting apparatus is provided with a housing forming a battery housing and a light housing separated via a partitioning wall. A light module is supported by the light housing and includes a heat sink located at least partially within the light housing and at least one LED supported by the heat sink. A battery receptacle formed within the battery housing to slidingly receive a battery pack at least partially into the battery housing. An intake opening is formed within the partitioning wall and an air vent is formed in fluid communication with the light housing. In operation, an airflow passes in thermal contact with the battery pack from the battery housing into the light housing through the intake opening, and from the light housing in thermal contact with the heat sink out of the air vent.

21 Claims, 8 Drawing Sheets

Related U.S. Application Data

(60) Provisional application No. 62/839,895, filed on Apr. 29, 2019.

(51) Int. Cl.

| | |
|---|---|
| ***F21V 5/04*** | (2006.01) |
| ***F21V 23/02*** | (2006.01) |
| ***F21V 23/04*** | (2006.01) |
| ***F21V 23/06*** | (2006.01) |

(56) References Cited

U.S. PATENT DOCUMENTS

| | | | | |
|---|---|---|---|---|
| 2014/0043800 | A1* | 2/2014 | Weber | F21V 29/767 362/190 |
| 2016/0178182 | A1* | 6/2016 | Maglica | H01L 33/483 362/373 |

* cited by examiner

LIGHT APPARATUS HAVING AIR FLOW

RELATED APPLICATION

This application is a continuation of U.S. patent application Ser. No. 16/854,208 filed Apr. 21, 2020 titled "SHED LIGHT," which claims the benefit of U.S. Provisional Application No. 62/839,895 filed Apr. 29, 2019 titled "SHED LIGHT," which is incorporated herein by reference in its entirety.

FIELD

This disclosure relates to a cordless light, and in particular to a cordless mountable light receiving a removeable battery pack.

BACKGROUND

Power tool battery packs have been used in recent years for a variety of lighting products used in construction sites. Examples of such lights include site area lights, such as the Dewalt® DCL070, capable of illuminating a large area of a construction site; tripod lights, such as the Dewalt® DCL079, adjustable to illuminate a desired location of workspace; hand-held flash lights, such as the Dewalt® DCL044, being portable and mountable for use in small spaces. What is needed is a light suitable for illuminating areas such as sheds, barns, stairways, and outdoor spaces, where the light may be subject to rain and high humidity.

SUMMARY

According to an embodiment, a lighting apparatus is provided including a housing forming a battery housing and a light housing separated via a partitioning wall. A light module is supported by the light housing and includes a heat sink located at least partially within the light housing and at least one LED supported by the heat sink. A battery receptacle formed within the battery housing to slidingly receive a battery pack at least partially into the battery housing. An intake opening is formed within the partitioning wall and an air vent is formed in fluid communication with the light housing. In operation, an airflow passes in thermal contact with the battery pack from the battery housing into the light housing through the intake opening, and from the light housing in thermal contact with the heat sink out of the air vent.

In an embodiment, the battery pack is received along a receiving axis that interests a portion of the light housing, where the airflow enters the battery housing through a gap formed between a wall of the battery housing and the battery pack.

In an embodiment, the intake opening is formed near a distal end of the partitioning wall adjacent the heat sink to allow the airflow to traverse through a gap between the partitioning wall and the battery pack before passing through the intake opening.

In an embodiment, the housing forms a rear mounting platform along a mounting plane that abuts the battery housing and the light housing, where a plane of the partitioning wall intersects the mounting plane.

In an embodiment, the battery receptacle includes a terminal block arranged to make electrical contact with terminals of the removeable battery pack, the terminal block being supported by a support wall extending perpendicularly from the partitioning wall.

In an embodiment, a control board is supported by the battery housing configured to control supply of electric power from the removable battery pack to the at least one LED.

In an embodiment, a sensor mounted on a front face of the battery housing forward of the battery receptacle, the sensor being at least one of a motion sensor or a darkness sensor.

In an embodiment, the light module further includes a lens covering the at least one LED, the lens being located forward of a plane of a front face of the battery housing.

In an embodiment, the lens is separated from the front face of the battery housing forming a secondary intake opening proximate the heat sink.

In an embodiment, the removeable battery pack is a 20V max power tool battery pack and the at least one LED provides a total light output of approximately 1200 to 2000 lumens.

In an embodiment, the light module includes a top light cover and a bottom light cover supporting the heat sink, the bottom light cover being coupled to a bottom portion of the light housing adjacent the intake opening of the partitioning wall, the top light cover being mounted on two side walls of the light housing extending upwardly from the partitioning wall.

In an embodiment, the light housing includes a ridge portion that overlaps a rear edge of the top light cover with a gap in between forming the air vent.

According to another embodiment, a lighting apparatus is provided including a housing forming a battery housing and a light housing. A battery receptacle is formed within the battery housing to slidingly receive a battery pack at least partially into the battery housing. A light module is supported by the light housing, the light module including a heat sink located at least partially within the light housing, and at least one LED supported by the heat sink. An air vent in fluid communication with the light housing, a first intake opening is formed between the battery housing and the light housing through which a first airflow passes in thermal contact with the battery pack into the light housing, and a second intake opening is formed between the light housing and a front face of the battery housing through which a second airflow passes from outside the lighting apparatus into the light housing in thermal contact with the heat sink.

In an embodiment, the battery pack is received along a receiving axis that interests a portion of the light housing, where the airflow enters the battery housing through a gap formed between a wall of the battery housing and the battery pack.

In an embodiment, a partitioning wall extending through the housing separates the battery housing from the light housing. In an embodiment, the first intake opening is formed within the partitioning wall proximate the heat sink.

In an embodiment, the housing forms a rear mounting platform along a mounting plane that abuts the battery housing and the light housing. In an embodiment, a plane of the partitioning wall intersects the mounting plane.

In an embodiment, a sensor is mounted on the front face of the housing below the second intake opening, the sensor being at least one of a motion sensor or a darkness sensor.

In an embodiment, the light module further includes a lens covering the at least one LED, where the lens is located forward of a plane of a front face of the battery housing to form the second intake opening between the lens and the front face of the battery housing.

In an embodiment, the removeable battery pack is a 20V max power tool battery pack and the at least one LED provides a total light output of approximately 1200 to 2000 lumens.

In an embodiment, the light module includes a top light cover and a bottom light cover supporting the heat sink, the bottom light cover being coupled to a bottom portion of the light housing adjacent the first intake opening, the top light cover being mounted on two side walls of the light housing.

In an embodiment, the light housing includes a ridge portion that overlaps a rear edge of the top light cover with a gap in between forming the air vent.

BRIEF DESCRIPTION OF THE DRAWINGS

The drawings described herein are for illustration purposes only and are not intended to limit the scope of this disclosure in any way.

DETAILED DESCRIPTION

Figure 1:
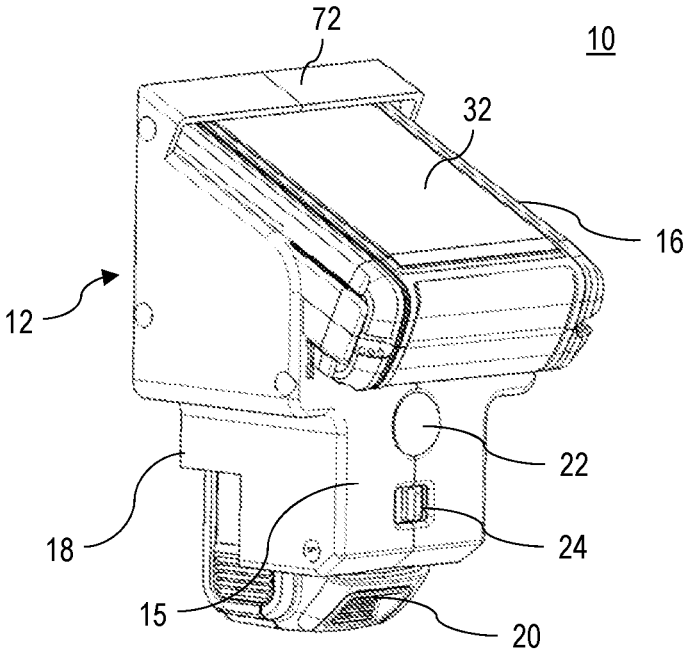
FIGS. 1 and 2 depict front and rear perspective views of a lighting apparatus, according to an embodiment.

The following description illustrates the claimed invention by way of example and not by way of limitation. The description clearly enables one skilled in the art to make and use the disclosure, describes several embodiments, adaptations, variations, alternatives, and uses of the disclosure, including what is presently believed to be the best mode of carrying out the claimed invention. Additionally, it is to be understood that the disclosure is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

Figure 2:
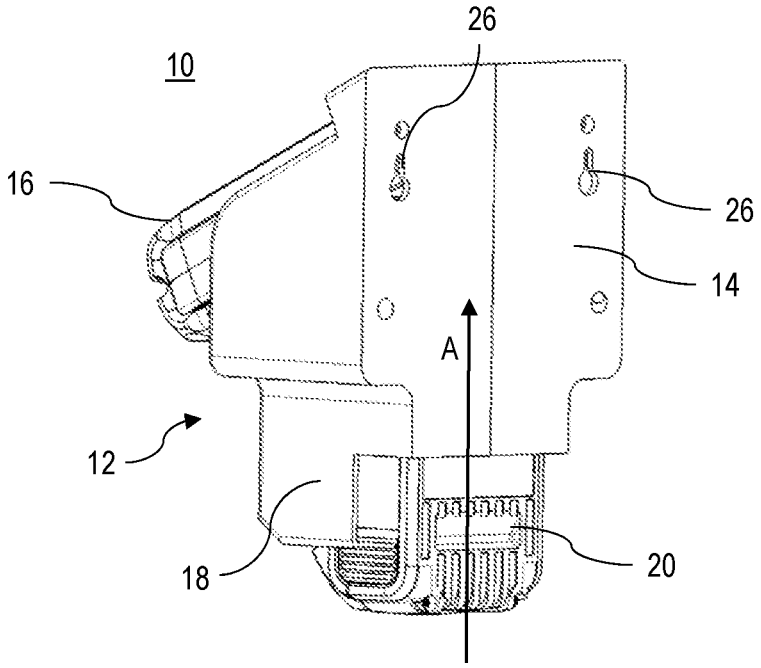

FIGS. 1 and 2 depict front and rear perspective views of a lighting apparatus 10, herein also referred to as a shed light, according to an embodiment. In an embodiment, lighting apparatus 10 includes a housing 12 having a rear mounting platform 14 for mounting on a wall. The housing 12 also includes a main body that supports a light module 16 including at least one light-emitting device (LED) light. In an embodiment, the light module 16 may include an array of LEDs (not shown) arrange in a series and/or parallel configuration to emit light of a desired luminance level. Alternatively and/or additionally, the light module 16 may include one or more Chip-on-Board (COB) LED devices. A COB LED is a package including multiple LED elements mounted directly on a substrate within a single module.

In an embodiment, the light module 16 is oriented angularly with respect to the housing 12 so the LED light emits lights at an angle of, for example, 30 to 60 degrees with respect to a plane of the rear mounting platform 14. In an embodiment, the light module 16 may be coupled to the housing 12 via a pivoting structure, allowing the angle of the light module 16 to be adjusted relative to the plane of the rear mounting platform 14.

In an embodiment, the housing 12 further supports a battery receptacle 18 that receives a sliding battery pack 20 in a direction A parallel to the plane of the rear mounting platform 14. The battery receptacle 18 may be arranged to receive the sliding battery pack 20 from an underside of the lighting apparatus 10 when the lighting apparatus 10 is mounted on a vertical wall.

In an embodiment, the one or more LEDs output 1200 to 2000 lumens, more preferably 1500 to 1700 lumens, when powered by a 20V max power tool battery pack. In an embodiment, a series of LEDs connected in series are provided where each LED outputs 400-500 lumens.

In an embodiment, a sensor 22 is disposed on a front face 15 of the housing 12 below the light module 16. The front face 15 is oriented parallel to the rear mounting platform 14 forward of the battery receptacle 18. The sensor 22 may be a motion sensor arranged to activate the LED light when it detects motion within a certain proximity. Additionally and/or alternatively, the sensor 22 may be a light/dark sensor that automatically detects a dark environment, detects motion in its sense range when it senses darkness in its vicinity, and activates the LED light accordingly. In addition, in an embodiment, a light switch 24 may be supported in the housing 12 below the sensor 22. The light switch 24 may be a and a light/dark sensor three-position switch that is switchable between ON, OFF, or sense modes.

In an embodiment, the rear mounting platform 14 includes a series of mounting holes 26 arranged to receive screws or nails on a wall. The arrangement of the mounting holes 26 ensures that the rear mounting platform 14 can be securely attached to a vertical wall with the battery receptacle 18 oriented downwardly to receive the battery pack 20 from an underside of the lighting apparatus 10. The downward-facing battery receptacle 18 also prevents water ingress into the light housing 12. Further, the downward orientation of the battery receptacle 18 allows for easy insertion and removal of the battery pack 20 while the lighting apparatus 10 is mounted at height on the wall.

Figure 3:
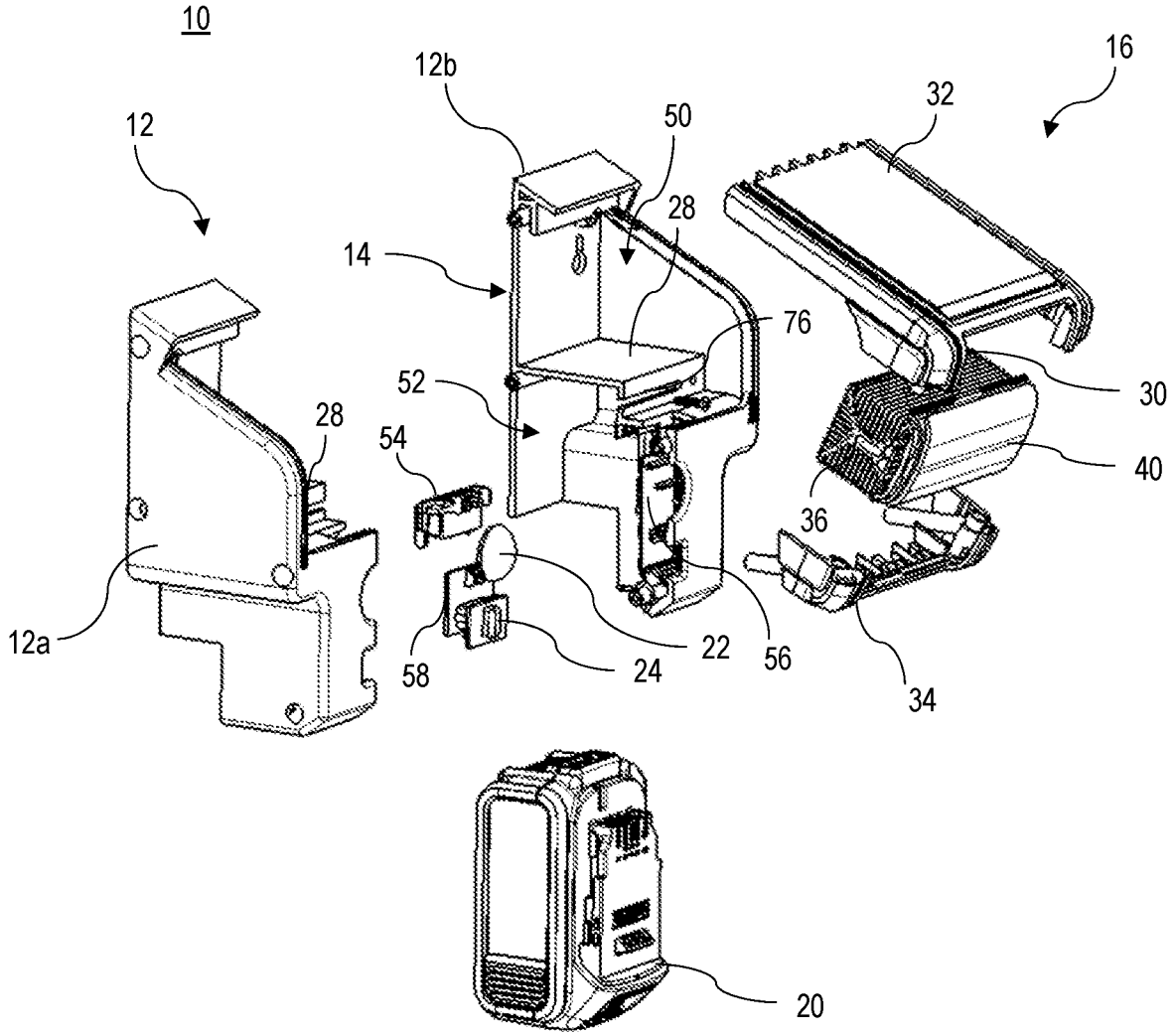
FIG. 3 depicts an exploded view of the lighting apparatus, according to an embodiment.
Figure 4:
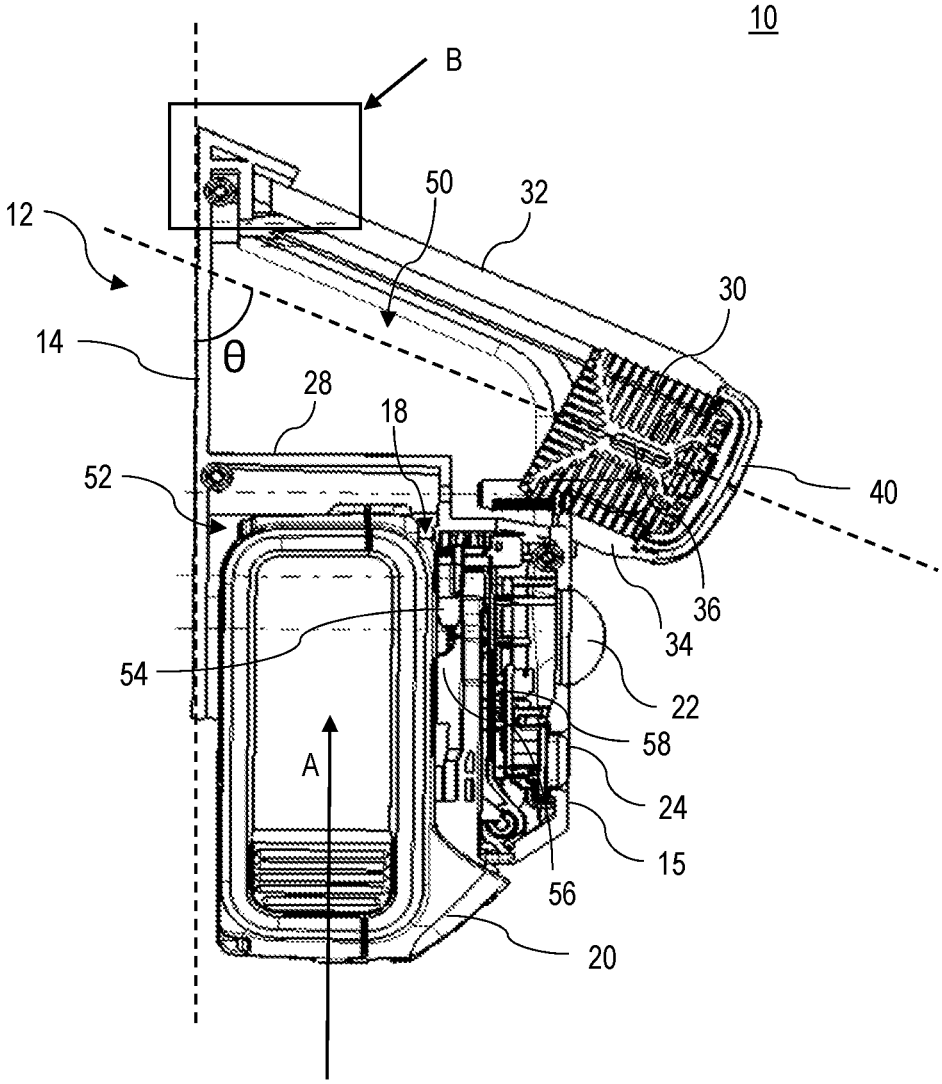
FIG. 4 depicts a cross-sectional side view of the lighting apparatus, according to an embodiment.

FIG. 3 depicts an exploded view of the lighting apparatus 10. FIG. 4 depicts a cross-sectional side view of the lighting apparatus 10. As shown in these figures, the housing 12 includes two clam shells 12*a*, 12*b*, that come together to form the rear mounting platform 14, the battery receptacle 18, and the light module 16. In an embodiment, the two clam shells 12*a*, 12*b* cooperate to form a partitioning wall 28 extending perpendicularly to the rear mounting platform 14. The partitioning wall 28 separates the housing 12 into two cavities—a first cavity 50 formed below the light module 16 and a second cavity 52 forming the battery receptacle 18.

In an embodiment, the light module 16 is oriented angularly with respect to the housing so the LED light emits lights at an angle θ of, for example, 30 to 60 degrees with respect to a plane of the rear mounting platform.

In an embodiment, the light module 16 includes a heat sink 30 in thermal communication with the first cavity 50 of the housing 12 and/or at least partially located within the first cavity 50 of the housing 12. The one or more LED lights (not shown) are mounted on a face of the heat sink 40 opposite the first cavity 50. The heat sink 30 is supported on two sides by the clam shells 12*a*, 12*b*. The housing 12 further includes a top light cover 32 and a bottom light cover 34, which cooperate with the clam shells 12*a*, 12*b* to support the top and bottom sides of the heat sink 30. The top and bottom light covers 32 and 34 include mating features that cooperate with corresponding mating features of the clam shells 12*a*, 12*b* to structurally support the heat sink 30 and encapsulate top and side surfaces of the heat sink 30.

In an embodiment, the heat sink 30 has a substantially cuboid-shaped body formed with fins projecting from a center portion 36 that extends along an axis parallel to the rear mounting platform 14. The heat sink 30 also includes a mounting surface (not shown) extending along a plane that is at an angle to the rear mounting platform 14. The one or more LED lights (not shown) are mounted on the mounting surface of the heat sink 30, either directly or via an insulating substrate such as a printed circuit board. In an embodiment, a lens or plastic cover 40 is further provided in front of the one or more LEDs and supported by the clam shells 12*a*, 12*b*, and top and bottom light covers 32, 34.

In an embodiment, the heat sink 40 is located forward of the partitioning wall 28 (i.e., intersecting a plane of the partitioning wall 28) such that at least an upper portion of the battery receptacle 18 is situated between the mounting platform 14 and the heat sink in a direction perpendicular to the plane of the rear mounting platform 14. In an embodiment, the heat sink also intersects a plane of the front face 15 of the housing 12 such that at least partially located forward of the plane of the front face 15 of the housing 12. This ensures that the light emitted from the LEDs is not blocked in the downward direction by the housing 12, the motion sensor 22, or other components.

In an embodiment, the battery receptacle 18 is formed within the second cavity 52 of the housing 12 formed by the two clam shells 12*a*, 12*b*, adjacent at least a portion of the rear mounting platform 14. In an embodiment, the partitioning wall 28 projects from approximately a midpoint of the rear mounting platform 14 such that a lower half of the rear mounting platform 14 is situation adjacent the battery pack 20 when battery pack 20 is received within the battery receptacle 18. The battery receptacle 18 includes a terminal block 54 supported by the clam shells 12*a*, 12*b*, and arranged to make electrical contact with the sliding battery pack 20. In an embodiment, the terminal block 54 is supported by a support wall 56 extending downwardly from the end of the partitioning wall 28. In an embodiment, battery receptacle 18 further includes a locking mechanism (not shown) to lock the battery pack 20 in place in a releasable manner. The downward-facing orientation of the battery receptacle 18 prevents water ingress into the light housing 12.

In an embodiment, a control board 58 on which a controller (not shown) such as a microprocess or a microcontroller is mounted is supported by the clam shells 12*a*, 12*b* adjacent to or in contact with the support wall 56. The controller regulates supply of electric power from the battery pack 20, through the terminal block 54, to the one or more LED lights. The controller is coupled to the sensor 22 to activate the LEDs when the switch 24 is in the sense mode and the sensor provides a signal to the controller indicative of motion within a dark environment.

Figure 5:
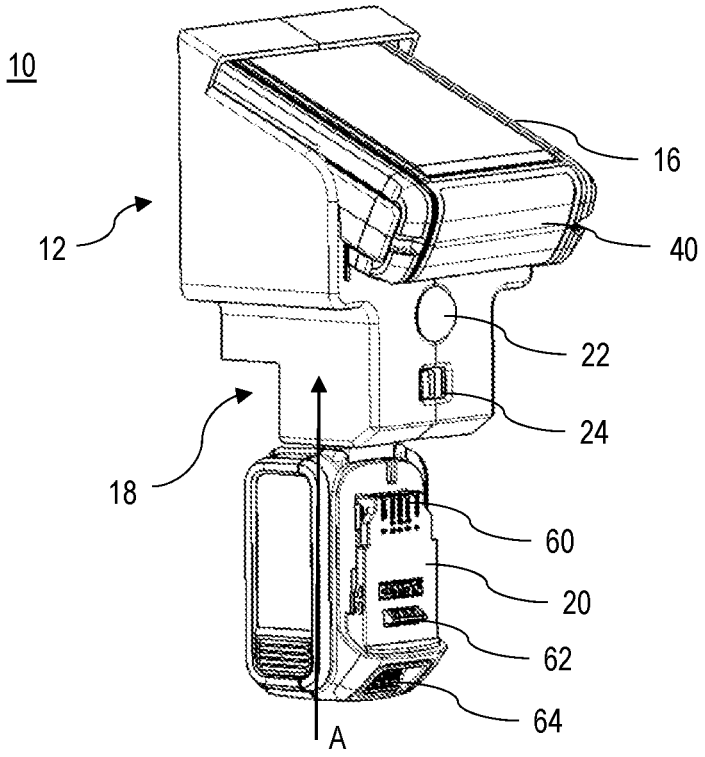
FIG. 5 depicts a view of the lighting apparatus prior to slidingly receiving the battery pack, according to an embodiment.

FIG. 5 depicts a view of the lighting apparatus 10 prior to slidingly receiving the battery pack 20. The battery pack 20 described herein is a power tool battery pack including battery terminals 60, locking mechanism 62, release mechanism 64, etc. U.S. Pat. No. 8,573,324, which is hereby incorporated by reference in its entirety, provides an example of a sliding power tool battery pack that slidingly couples to a power tool. In an embodiment, battery terminals 60 make electrical contact with the terminal block 54 (FIG. 4) of the lighting apparatus 10. The locking mechanism 62 engages a locking rib or notch (not shown) of the lighting apparatus 10 to lock the battery pack 20 in place. The release mechanism 64, when pressed by a user, disengages the locking mechanism 62 to release the battery pack 20.

Figure 6:
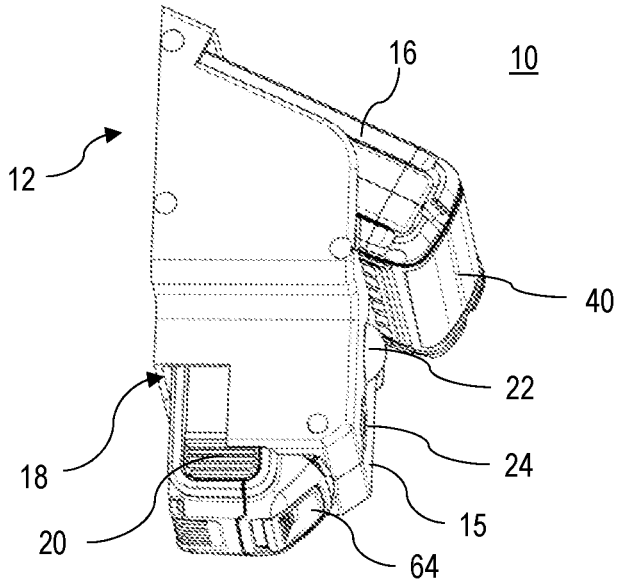
FIG. 6 depicts a perspective bottom view of the lighting apparatus with the battery pack received in the battery receptacle, according to an embodiment.

FIG. 6 depicts a perspective bottom view of the lighting apparatus 10 with the battery pack 20 received in the battery receptacle 18. As shown herein, with the battery pack 20 is locked in place within the battery receptacle 18, the release mechanism 64 of the battery pack 20 is accessibly situated under the front face 15 of the lighting apparatus 10.

Figure 7:
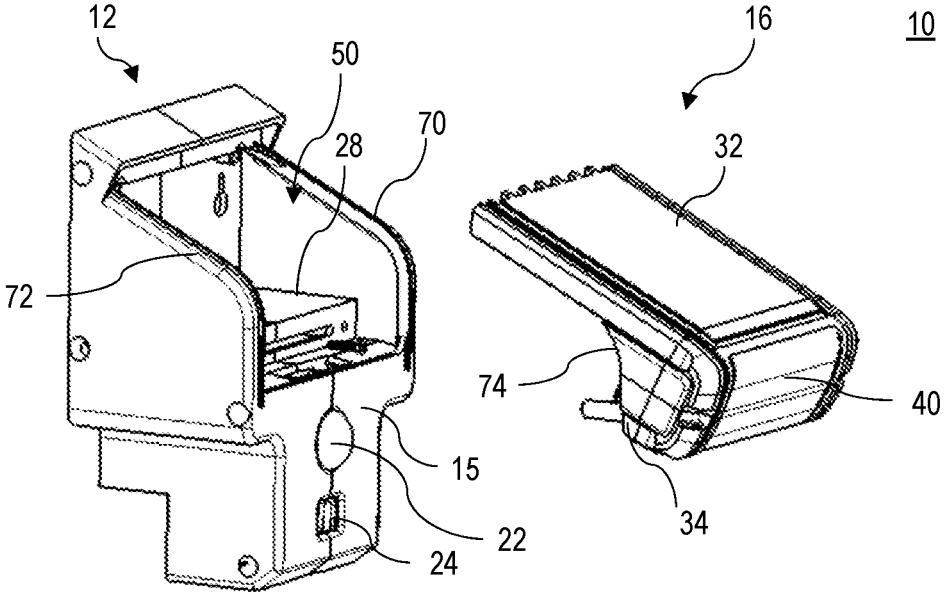
FIG. 7 depicts a partially exploded view of the lighting apparatus, according to an embodiment.

FIG. 7 depicts a partially exploded view of the lighting apparatus 10. As shown herein, the top and bottom light covers 32 and 34 mate together to modularly support the heat sink 30, the one or more LEDs (not shown), and the lens 40, together forming the light module 16. The top light cover 32 extends rearwardly from the heat sink 30 and is supported on side walls 70, 72 of the housing 12. The two side walls, together with the partitioning wall 28, form the first cavity 50. Arcuate portions 74 formed by the top and bottom light covers 32 and 34 along the sides of the light module 16 are shaped to mate with curved portions of the side walls 70, 72 to support positioning the front portion of the light module 16, including the lens 40, the one or more LEDs (not shown), and at least a portion of the heat sink 30, forward of the housing 12. In an embodiment, at least a portion of the heat sink 30 is located within the cavity 50 when assembled.

Figure 8:
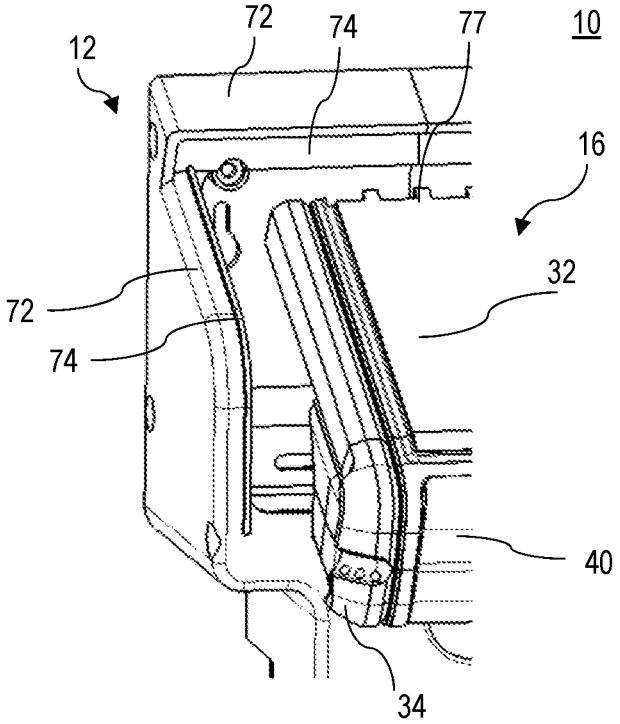
FIG. 8 depicts a partial angular exploded view of the lighting apparatus, according to an embodiment.

FIG. 8 depicts a partial angular exploded view of the lighting apparatus 10. As shown here, each of the two side walls 70 and 72, of which only side wall 72 is shown, includes a rib 74 projecting outwardly from the edge of the side wall. The top light cover 32 includes corresponding overlapping channels (not shown) that receive the ribs 74 therein when the top light cover 32 is mounted over the side walls 72 and 74, forming a tongue-and-groove sealing arrangement. This arrangement prevents flow of water ingress from the sides of the lighting apparatus 10 into the first cavity 50 and/or the light module 16 to damage the LEDs, the control board 58, or other electronic components.

Figure 9:
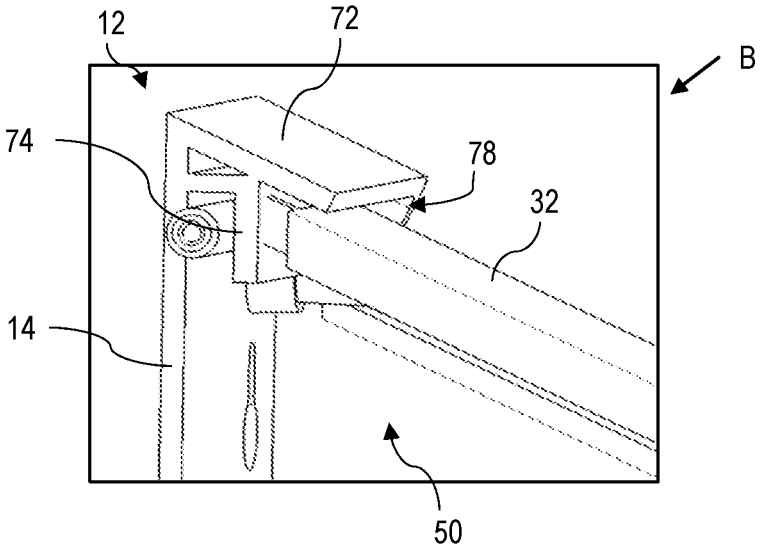
FIG. 9 depicts a zoomed-in cross-sectional perspective view of the area designated as 'B' in FIG. 4, according to an embodiment.

FIG. 9 depicts a zoomed-in cross-sectional perspective view of the area designated as 'B' in FIG. 4. As shown in FIG. 9, and with continued reference to FIG. 8, the housing 12 includes a ridge vent 78 defined between an upper portion of the rear mounting platform 14 and the top light cover 32. In an embodiment, housing 12 includes a ridge portion 72 formed by the clam shells 12*a* and 12*b* that extends angularly with respect to the rear mounting platform 14. The top light cover 32 is received under the ridge portion 72 and comes close to, or in contact with, a rib 74 that extends downwardly from a middle of the ridge portion 72. In an embodiment, the top light cover 32 includes a series of projections 77 that come into contact with the rib 74, forming a series of windows therebetween. The ridge portion 72 thus extends substantially in parallel to the top light cover 32 and overlapping the top light cover 32 with a gap therebetween forming the ridge vent 78. The ridge vent 78 allows air to escape the first cavity 50, as discussed below in detail, while preventing water ingress into the housing 12. As shown in FIG. 1, the ridge portion 72 of the housing 12 and the and the top light cover 16 together form a surface to shed rain water without ingress into the housing 12.

Figure 10:
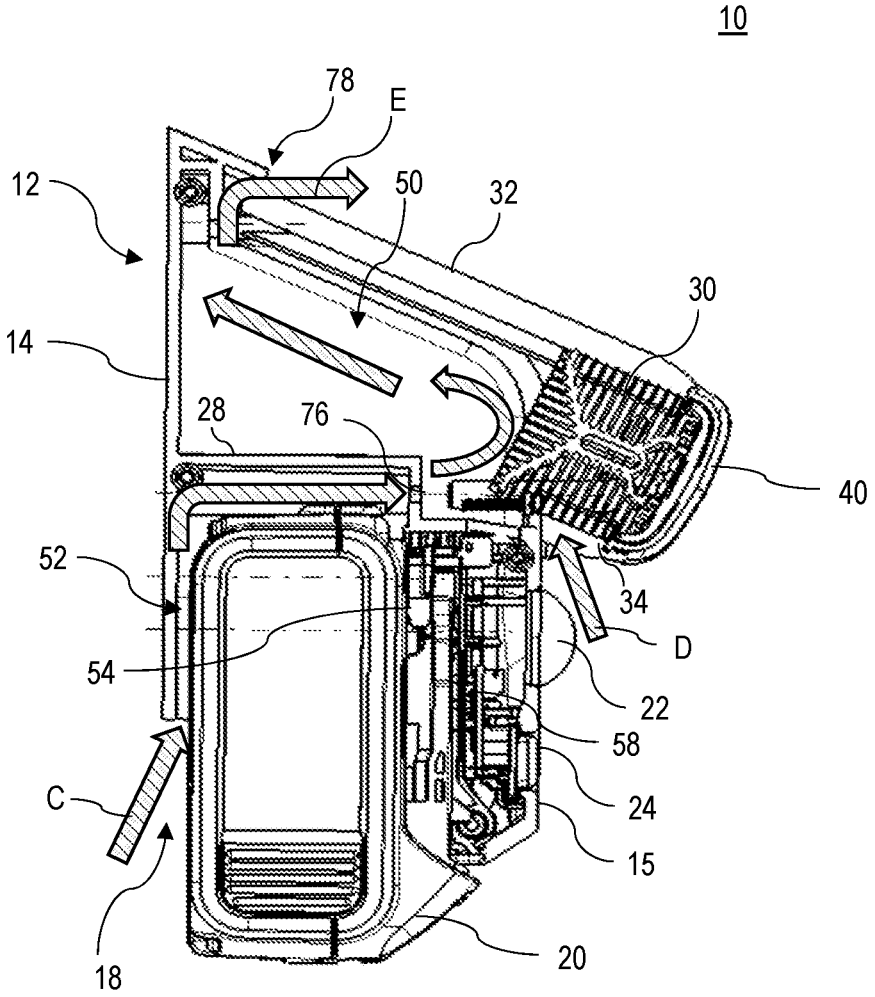
FIG. 10 depicts a side view of the lighting apparatus similar to FIG. 4, additionally showing path C-E of airflow through the lighting apparatus, according to an embodiment.

FIG. 10 depicts a side view of the lighting apparatus 10 similar to FIG. 4, additionally showing path C-E of airflow through the lighting apparatus. In an embodiment, the battery receptacle 18 provides an air vent in the form of a gap between the battery pack 20 and the rear mounting wall 14, which allows cooling air to enter the lighting apparatus 10 (path C) by natural convection. The cooling air may act to cool the battery pack 20, the terminal block 54, and the control board 58. A downstream opening 76 is provided between the second cavity 52 and the first cavity 50 to allow passage of said air into the first cavity 50 from the battery receptacle 18. Additionally, an additional air vent is provided in form of an opening in the bottom light cover 34, or in form of a gap between the bottom light cover 34 and the front face 15 of the housing 12, which allows cooling air to enter the light module 16 (path D) by natural convection. Cooling air flowing via path D, independently or in combination with at least part of the air flowing via path C, makes fluid contact with the heat sink 30 prior to entering the first cavity 50 of the housing 12. The heat dissipated by the heat sink 30 creates a chimney effect to suck air through paths C and D. The warm air exists the first cavity 50 through the ridge vent described above (path E).

Figure 11:
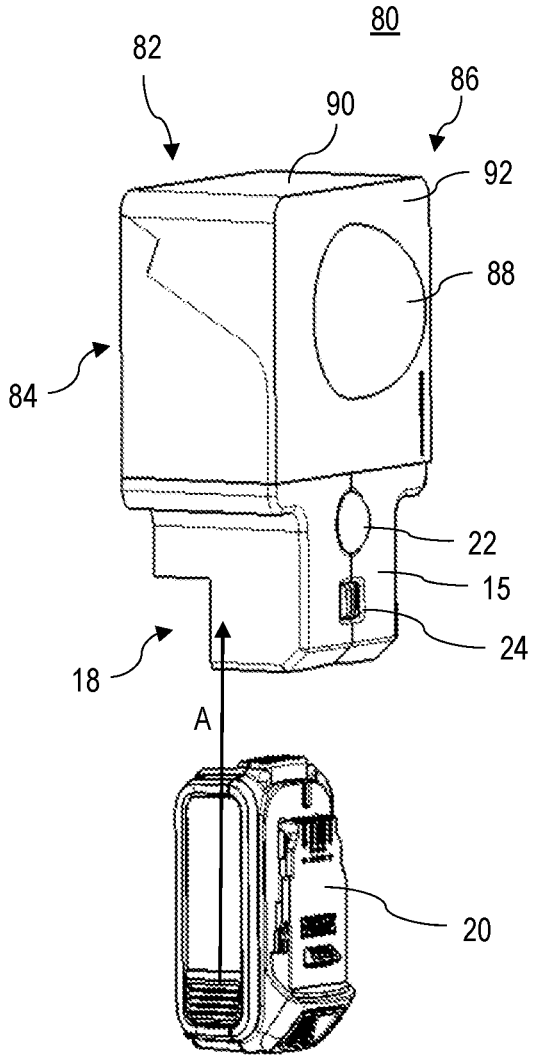
FIGS. 11 and 12 depict perspective views of a lighting apparatus according to an alternative embodiment of the invention.
Figure 12:
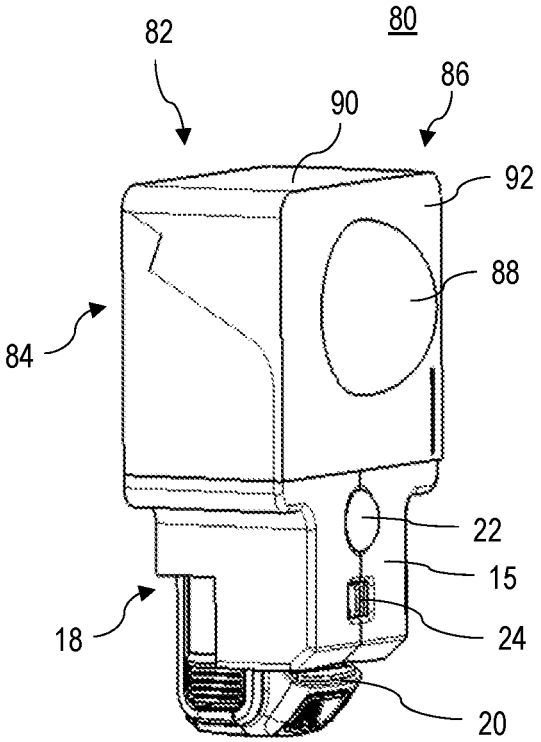

FIGS. 11 and 12 depict perspective views of a lighting apparatus 80 according to an alternative embodiment of the invention. In this embodiment, the light apparatus 80 includes many of the same features previously described, including a battery receptacle 18 for receiving a sliding power tool battery pack 20 in direction A, a sensor 22 disposed on a front face 15 of the light apparatus 80 adjacent he battery receptacle 18, a three-position switch 24 disposed below the sensor 22. Also, similar to the above-described embodiment, housing 82 of the lightning apparatus 80 includes a rear mounting platform 84 for mounting the lighting apparatus on a vertical wall, and a light module 86 provided forward of the rear mounting platform 84 above the battery receptacle 18.

In an embodiment, lighting apparatus 80 is provided with an unslanted light module 86 design, where top light cover 90 of the light module 86 is substantially horizontal relative to the rear mounting platform 84.

In an embodiment, a front face 92 of the light module 86 is substantially in-line with front face 15 of the light apparatus 80. Alternatively, front face 92 of the light module 86 is forward of the front face 15 of the light apparatus 80 by up to 1 cm. In an embodiment, a semi-spherical light lens 88 is provided on the front face 92 of the light module 85. The lens 88 projects forwardly of the front face 92 to allow reflection of the light in the downward direction without interference from other light components. In an embodiment, the lens 88, the light module 86, and the housing 82 may be sealed to prevent water ingress inside the lighting apparatus 80. The downward-facing orientation of the battery receptacle 18 also prevents water ingress into the lighting apparatus 80.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. A lighting apparatus comprising:

a housing including a battery housing and a light housing separated via a partitioning wall extending within the housing;

a light module supported by the light housing, the light module comprising a heat sink located at least partially within the light housing, and at least one LED supported by the heat sink;

a battery receptacle formed within the battery housing to slidingly receive a battery pack at least partially into the battery housing, the battery pack being a removeable power tool battery pack for manual connection and disconnection, the battery housing having an open end through which the battery pack is removably receivable, the battery receptacle including a terminal block arranged to releasably make electrical contact with terminals of the battery pack;

an intake opening formed within the partitioning wall between the battery housing and the light housing; and an air vent in fluid communication with the light housing;

wherein, in operation, an airflow enters through the open end of the battery housing, passes in thermal contact with the battery pack from the battery housing into the light housing through the intake opening, and passes from the light housing in thermal contact with the heat sink out of the air vent.

2. The lighting apparatus of claim 1, wherein the battery pack is received along a receiving axis that interests a portion of the light housing, and wherein the airflow enters the battery housing through a gap formed between a wall of the battery housing and the battery pack.

3. The lighting apparatus of claim 2, wherein the intake opening is formed near a distal end of the partitioning wall adjacent the heat sink to allow the airflow to traverse through a gap between the partitioning wall and the battery pack before passing through the intake opening.

4. The lighting apparatus of claim 1, wherein the housing forms a rear mounting platform along a mounting plane that abuts the battery housing and the light housing, wherein a plane of the partitioning wall intersects the mounting plane.

5. The lighting apparatus of claim 1, wherein the terminal block is supported by a support wall extending perpendicularly from the partitioning wall, and wherein the battery pack includes a locking mechanism and a release mechanism to lock and release from engagement with the battery receptacle.

6. The lighting apparatus of claim 1, further comprising a control board supported by the battery housing configured to control supply of electric power from the battery pack to the at least one LED.

7. The lighting apparatus of claim 1, further comprising a sensor mounted on a front face of the battery housing forward of the battery receptacle, the sensor being at least one of a motion sensor or a darkness sensor.

8. The lighting apparatus of claim 1, wherein the light module further comprises a lens covering the at least one LED, the lens being located forward of a plane of a front face of the battery housing.

9. The lighting apparatus of claim 8, wherein the lens is separated from the front face of the battery housing forming a secondary intake opening proximate the heat sink.

10. The lighting apparatus of 1, wherein the battery pack is a 20V max power tool battery pack and the at least one LED provides a total light output of approximately 1200 to 2000 lumens.

11. The lighting apparatus of claim 1, wherein the light module comprises a top light cover and a bottom light cover supporting the heat sink, the bottom light cover being coupled to a bottom portion of the light housing adjacent the intake opening of the partitioning wall, the top light cover being mounted on two side walls of the light housing extending upwardly from the partitioning wall.

12. The lighting apparatus of claim 11, wherein the light housing comprises a ridge portion that overlaps a rear edge of the top light cover with a gap in between forming the air vent.

13. A lighting apparatus comprising:

a housing including a battery housing and a light housing;

a battery receptacle formed within the battery housing to slidingly receive a battery pack at least partially into the battery housing, the battery pack being a removeable power tool battery pack for manual connection and disconnection, the battery housing having an open end through which the battery pack is removably receivable, the battery receptacle including a terminal block arranged to releasably make electrical contact with terminals of the battery pack;

a light module supported by the light housing, the light module comprising a heat sink located at least partially within the light housing, and at least one LED supported by the heat sink;

an air vent in fluid communication with the light housing;

a first intake opening formed between the battery housing and the light housing through which a first airflow entering through the open end of the battery housing passes in thermal contact with the battery pack into the light housing;

a second intake opening formed between the light housing and a front face of the battery housing through which a second airflow passes from outside the lighting apparatus into the light housing in thermal contact with the heat sink.

14. The lighting apparatus of claim 13, wherein the battery pack is received along a receiving axis that interests a portion of the light housing, and wherein the airflow enters the battery housing through a gap formed between a wall of the battery housing and the battery pack.

15. The lighting apparatus of claim 13, further comprising a partitioning wall extending through the housing separating the battery housing from the light housing, wherein the first intake opening is formed within the partitioning wall proximate the heat sink.

16. The lighting apparatus of claim 15, wherein the housing forms a rear mounting platform along a mounting plane that abuts the battery housing and the light housing, wherein a plane of the partitioning wall intersects the mounting plane.

17. The lighting apparatus of claim 13, further comprising a sensor mounted on the front face of the housing below the second intake opening, the sensor being at least one of a motion sensor or a darkness sensor.

18. The lighting apparatus of claim 13, wherein the light module further comprises a lens covering the at least one LED, wherein the lens is located forward of a plane of a front face of the battery housing to form the second intake opening between the lens and the front face of the battery housing.

19. The lighting apparatus of 13, wherein the battery pack is a 20V max power tool battery pack and the at least one LED provides a total light output of approximately 1200 to 2000 lumens.

20. The lighting apparatus of claim 13, wherein the light module comprises a top light cover and a bottom light cover supporting the heat sink, the bottom light cover being coupled to a bottom portion of the light housing adjacent the first intake opening, the top light cover being mounted on two side walls of the light housing.

21. The lighting apparatus of claim 20, wherein the light housing comprises a ridge portion that overlaps a rear edge of the top light cover with a gap in between forming the air vent.

* * * * *